US011470945B2

(12) United States Patent
Niedermann

(10) Patent No.: US 11,470,945 B2
(45) Date of Patent: Oct. 18, 2022

(54) PEN AS A CONTAINER FOR A NAIL GEL, BRUSH FOR APPLICATION AND LED FOR CURING THE GEL

(71) Applicant: Yves Swiss AG, Sursee (CH)

(72) Inventor: Claude Niedermann, Oberkirch (CH)

(73) Assignee: Yves Swiss AG, Sursee (CH)

( * ) Notice: Subject to any disclaimer, the term of this patent is extended or adjusted under 35 U.S.C. 154(b) by 0 days.

(21) Appl. No.: 17/421,960

(22) PCT Filed: Jan. 10, 2020

(86) PCT No.: PCT/EP2020/050555
§ 371 (c)(1),
(2) Date: Jul. 9, 2021

(87) PCT Pub. No.: WO2020/144337
PCT Pub. Date: Jul. 16, 2020

(65) Prior Publication Data

US 2022/0039537 A1 Feb. 10, 2022

(30) Foreign Application Priority Data

Jan. 10, 2019 (CH) ..... 00021/19
Jul. 3, 2019 (CH) ..... 00875/19

(51) Int. Cl.
*A45D 40/26* (2006.01)
*A45D 40/18* (2006.01)
*A45D 40/20* (2006.01)

(52) U.S. Cl.
CPC ..... *A45D 40/262* (2013.01); *A45D 40/18* (2013.01); *A45D 2040/204* (2013.01); *A45D 2200/205* (2013.01)

(58) Field of Classification Search
CPC .... A45D 40/262; A45D 40/265; A45D 40/18; A45D 2040/204; A45D 2200/205
See application file for complete search history.

(56) References Cited

U.S. PATENT DOCUMENTS

| | | | | |
|---|---|---|---|---|
| 10,216,283 | B2 * | 2/2019 | Acer | G06F 3/016 |
| 10,769,390 | B2 * | 9/2020 | Shiga | G06F 3/014 |
| 2007/0181142 | A1 * | 8/2007 | Tufts | A45D 31/00 132/73 |

(Continued)

FOREIGN PATENT DOCUMENTS

| | | | |
|---|---|---|---|
| DE | 102012016952 | A1 | 9/2013 |
| JP | 2005118207 | A | 5/2005 |
| WO | 2017217786 | A1 | 12/2017 |

OTHER PUBLICATIONS

Written Opinion and International Search Report for PCT/EP2020/050555; dated May 6, 2020.

(Continued)

*Primary Examiner* — J C Jacyna
(74) *Attorney, Agent, or Firm* — Polsinelli PC

(57) ABSTRACT

A pen has an external shape similar to that of a ballpoint pen or fountain pen. The pen includes a cavity in the tube type pen body for receiving gel varnish, and a brush for applying this to a finger nail. At the front end of the pen body, a sleeve is positioned which can be screwed on, and contained therein are LED/LEV lights, with a battery, for curing the applied gel varnish with UV light.

3 Claims, 2 Drawing Sheets

(56) References Cited

U.S. PATENT DOCUMENTS

| | | | | |
|---|---|---|---|---|
| 2010/0066710 | A1* | 3/2010 | Koibuchi | G06F 1/16 345/205 |
| 2011/0091263 | A1 | 4/2011 | Von Eberstein et al. | |
| 2014/0246037 | A1* | 9/2014 | Drake | F21V 33/0004 132/73.5 |
| 2015/0213352 | A1* | 7/2015 | Niedermann | G06K 19/0723 132/73 |
| 2016/0220006 | A1 | 8/2016 | Le et al. | |
| 2016/0295989 | A1* | 10/2016 | Hakeem | G09G 5/02 |
| 2017/0296363 | A1* | 10/2017 | Yetkin | A61F 2/72 |
| 2017/0354235 | A1 | 12/2017 | Miller | |
| 2019/0223575 | A1* | 7/2019 | Cephus | A44C 15/0015 |

OTHER PUBLICATIONS

English Translation of International Search Report for PCT/EP2020/050555; dated May 6, 2020.
English Abstract of DE102012016952 retrieved from https://worldwide.espacenet.com/ on Jun. 8, 2021.
English Abstract of JP2005118207 retrieved from https://worldwide.espacenet.com/ on Jun. 8, 2021.
English Abstract of WO2017217786 retrieved from https://worldwide.espacenet.com/ on Jun. 8, 2021.

* cited by examiner

PEN AS A CONTAINER FOR A NAIL GEL, BRUSH FOR APPLICATION AND LED FOR CURING THE GEL

CROSS-REFERENCE TO RELATED APPLICATIONS

This application is a national stage application of International Application Number PCT/EP2020/050555, which was filed on Jan. 10, 2020, which claims priority to Switzerland Application Number 00021/19 filed on Jan. 10, 2019 and 00875/19 filed Jul. 3, 2019, each of which is incorporated by reference in its entirety.

FIELD

The invention relates to a pen which is easy to carry in a handbag or jacket pocket and which allows a nail gel to be applied quickly and safely to a finger nail and then cured by means of UV light. In a particular embodiment, the pen can contain an RFID or NFC chip, i.e. a transponder chip, so that it can be placed on a finger nail using the nail gel or can be set onto the finger nail in a self-adhesive manner and be covered with gel so that it is held in place by the gel or gel varnish, either visibly in the case of clear varnish or invisibly in the case of a top coat or gel. The chip can be concealed under or on top of the nail varnish or a nail processing system (gel varnish, acrylic, wrap, or the like). In this way, an RFID chip can be elegantly attached to a natural or artificial finger nail or toe nail.

BACKGROUND

Ordinary nail varnish lasts for about 2 to 3 days after application, then it becomes brittle and can chip off. Nail gel or gel varnish, on the other hand, has to be applied far less often. After application, for example with a brush, the gel is cured with a special light source that emits UV light, and a finger nail coated in this way remains beautiful for about 2 weeks, and the gel lasts over this period of time without any loss of quality. When traveling, curing often remains a problem because a suitable UV light source is missing.

The main object of the present invention is therefore to create a portable utensil which contains everything necessary to safely apply a nail gel on the go and to cure it on the nail by means of UV light. The object of a particular embodiment is to create such a utensil, which also contains everything necessary to connect an RFID chip securely, inconspicuously, and non-invasively to a human body in such a way that the RFID chip can be carried securely on the body anywhere and for all activities, and yet it can be removed or exchanged at any time.

The main object is achieved by a pen having a closable cavity for receiving gel varnish and a brush for applying this to a finger nail, as well as a battery-operated LED/LEV light for UV light for curing gel varnish applied with a brush to a finger nail. The extended object is achieved by such a pen with an additional closable cavity for at least one RFID chip.

BRIEF DESCRIPTION OF THE DRAWINGS

In the drawings, an embodiment of this pen is shown and the structure and function thereof are described and explained below.

In the drawings.

DETAILED DESCRIPTION

Figure 1:
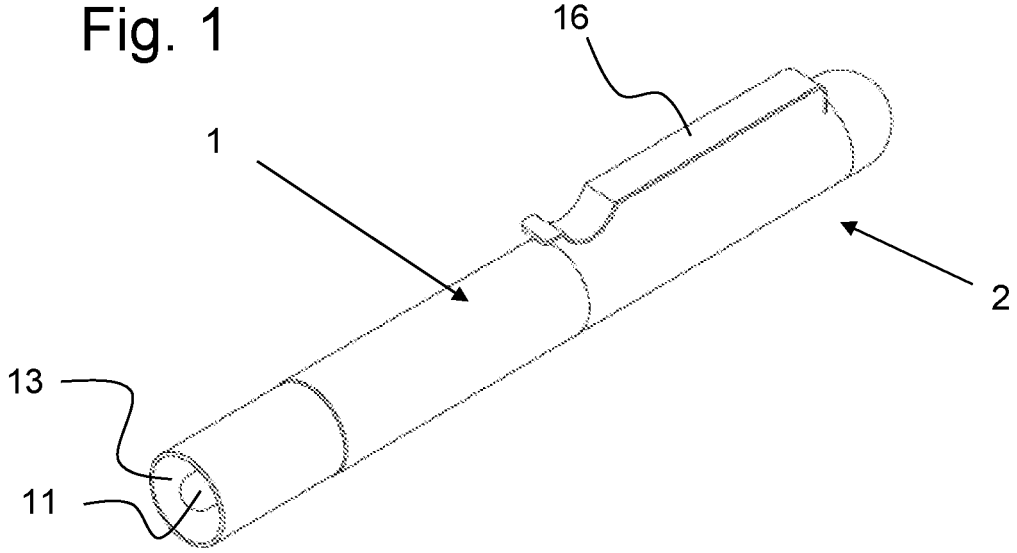
FIG. 1: is the pen in a perspective view.

Seen from the outside, the pen is designed similarly to a writing pen, of similar thickness and length, as shown in FIG. 1. This means that it can be carried anywhere in a jacket pocket or handbag and is always ready to hand. This pen contains a plurality of cavities and consists of a pen body 1 and a lid cap 2 that can be slipped or screwed thereonto. At the front end of the pen 1, a light 11 based on a light emitting diode LED or a levitating lamp LEV 11 is installed, i.e. an LED or LEV light 11 that is enclosed and protected by an inner cone 13 opening to the outside. A clip-on clip 16, preferably made of metal, allows the pen to be secured when it is carried, for example, in an inside pocket of a jacket. This clip 16 can also be porous or have a rough surface so that it is suitable for filing a natural or artificial nail. In addition, in a special design, the pen can serve as a container for one or more chips, as will be shown below.

Figure 2:
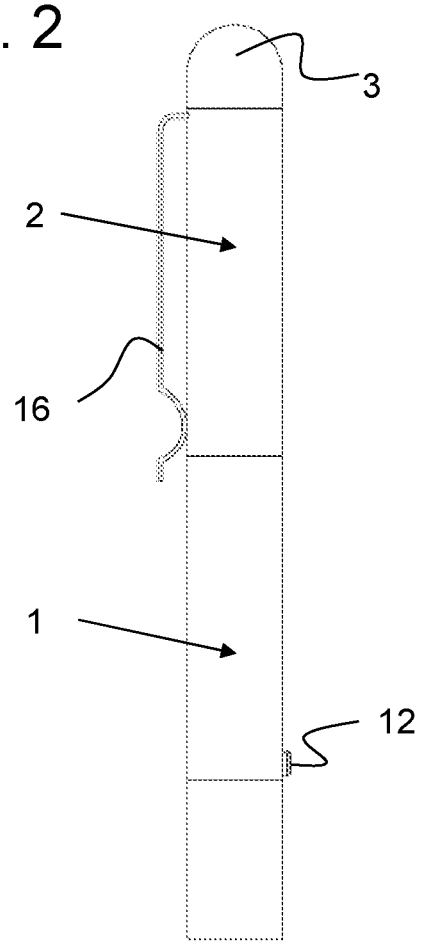
FIG. 2: is the pen in a side view.

In FIG. 2, the pen is shown in a side view. Compared to the clip-on clip 16, a switch 12 for switching the LED or LEV light 11 on and off, which is visible in FIG. 1, can be seen in the front region. A threaded cap 3 is screwed onto the lid cap 2.

Figure 3:
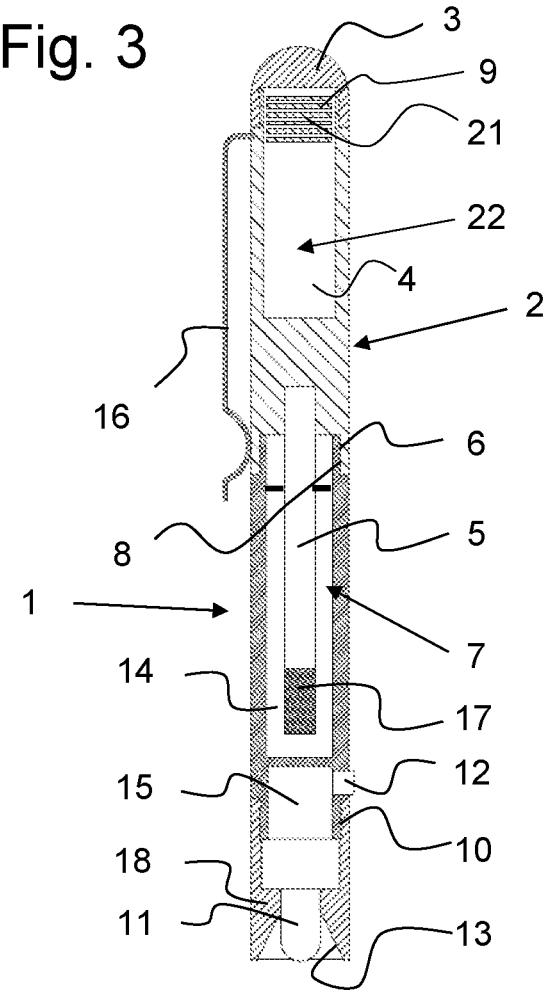
FIG. 3: is the pen shown in a longitudinal section.

FIG. 3 shows the pen in a longitudinal section and thus gives a view of its interior. The pen body 1 has a cavity 7 in the form of a blind hole, which is accessible when the lid cap 2 is screwed off or pulled off. It is partially filled with a gel varnish 14 in the form of a special nail varnish which hardens under UV light. At the lower end of the lid cap 2, a brush 5 extends axially out of the lid cap and this brush 5 can be inserted into the blind hole, i.e. into the cavity 7 in the pen body 1, the brush dipping into the gel varnish 14 contained therein. The lid cap 2 can be screwed to the pen body 1 in a sealing manner, for which purpose an external thread 6 is provided on the pen body 1, onto which the internal thread can be screwed at the lower end of the lid cap 2. Instead of a threaded connection, a plug connection with a snapping engagement can be used.

The brush 5 itself consists of a handle made of plastics material and having flat bristles 17 at the ends which are suitable for applying a liquid gel varnish 14 to a finger nail. In an optional embodiment, the pen body 1 can be designed so that it forms a flat compartment next to the blind hole 7 for the gel varnish 14, similar to a knife sheath into which a nailfile with or without a handle can be inserted. The lid cap 2 can then form a handle for this nailfile, for easier processing of a finger nail. The lower end of the pen body 1 has a further, downwardly open blind hole, which is designed as a battery compartment, for receiving a battery 15 or a rechargeable battery. The pen body 1 can also be equipped with a photovoltaic element to continuously charge the battery as soon as sufficient light hits this element. In addition, the pen body 1 can be equipped with an externally accessible USB socket for plugging in a charging cable. The lower end of the pen body 1 forms a step and a taper, which is provided with an external thread 10. The matching internal thread of a sleeve 18 can be screwed onto this external thread 10, enclosing and making electrical contact with the battery 15, for example a button battery for an LED or LEV light 11 at the other end of the sleeve 18, which is located there in an inner cone 13, which extends toward the outside to the lower edge of the sleeve 18. An on-off switch 12 is installed on the side of the pen body 1 in order to switch the light 11 on and off.

In the interior of the lid cap 2, a cylindrical cavity 22 is located in the form of a blind hole in the example shown. A plurality of RFID chips 21 can be inserted into this cavity 22 and stored therein. The cavity 22 can be closed on the lid cap 2 by means of a threaded cap 3. The lid cap 2 can be equipped with a clip-on clip 16, as in the case of a fountain pen.

Each of these RFID chips 21 can interact with an RFID or NFC system if it is held close enough to a transmitter/receiver of an RFID or NFC system. This RFID chip 21 acts as a transponder, also known colloquially as a wireless tag, and it can be located on an object or in a living being and contain an identifying code. The RFID or NFC system includes a reading device for reading out the identifier of a detected RFID chip 21. RFID transponders can be as small as a grain of rice and can be implanted, for example in pets or humans. In addition, there is the possibility of producing RFID or NFC transponders using a special printing process for stable circuits made of polymers. The advantages of this technology result from the combination of the small size, the inconspicuous readout option, and the low price of the transponder, sometimes in the euro cent range. The coupling takes place via magnetic alternating fields generated by the reading device within a short range or via high-frequency radio waves. This not only transfers data, but also supplies the transponder with energy. To achieve greater ranges, active transponders with their own power supply are used, but these are associated with higher costs. The reading device contains software in the form of a micro-program that controls the actual reading process, and an RFID middleware with interfaces to other IT systems and databases. By identifying the RFID chip 21 on a person, a connection to a software application can be established, which allows for a wide range of applications.

This pen, filled with gel varnish and equipped with a plurality of RFID chips 21, makes it possible to mount such a chip 21 anytime and anywhere on a natural or artificial finger nail. For this purpose, the finger nail is prepared as necessary with the nailfile. Subsequently, the desired RFID chip 21 is removed from the blind hole 22 after the threaded cap 3 has been unscrewed, and the threaded cap 3 is screwed on again in order to secure the remaining RFID chips 21 contained. The removal can also take place by pushing out the individual RFID or NFC chips 21. Then the lid cap 2 is unscrewed or pulled off the pen body 1. Now it can be applied to the finger nail with the brush 5 while removing gel varnish 14 from the blind hole 7 in the pen body 1. The removed RFID chip 21 can be placed directly on the natural or artificial nail since this can already be provided with adhesive. Or this chip can be placed on the applied varnish or gel varnish layer on the finger nail and then painted over with varnish so that it is completely enclosed by the varnish or gel varnish. A plurality of layers of gel 14 can be applied until the RFID chip 21 is completely covered by gel varnish. Thereafter, the lid cap 2 is screwed or plugged back onto the pen body 1 and then the switch 12 is set to ON, so that the LED or LEV light 11 is switched on. The emitted UV light is directed onto the gel varnish 14 on the finger nail, which ensures that it cures in a few seconds. After the gel varnish 14 is cured, the RFID chip 21 is secured and embedded into a layer of nail varnish or gel 14 on the finger nail either invisibly—or, if desired, also visibly, simply by thin coating.

In this way, different RFID chips 21 can be attached to the different finger nails of a hand. One RFID chip can serve, for example, to trigger a financial transaction through the NFC identification of the paying person, who, in this case, only has to hold their finger nail with the relevant RFID chip 21 near a transmitter/reading device set up for this purpose. Another finger nail with a different RFID chip 21 can be used, for example, to unlock and lock a car door, another for operating the lock on the apartment door, etc. One chip can also offer the possibility of triggering a plurality of applications.

Figure 4:
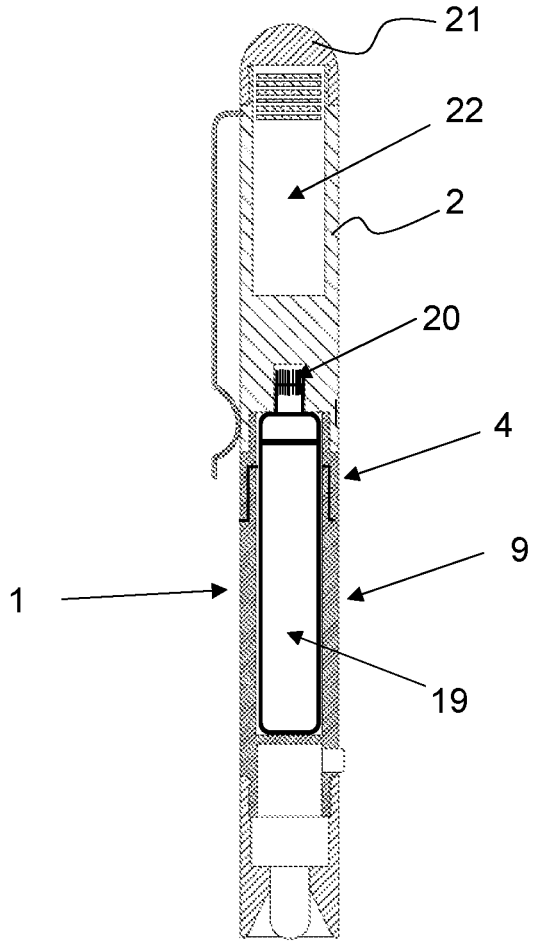
FIG. 4: is a pen with a two-part pen body with a rotatable gel cartridge and a container for one or more RFID chips.

FIG. 4 shows an embodiment of the pen with a two-part pen body 1, an upper 4 and lower pen body 9. In this embodiment, the gel can be contained in a cartridge 19 which fits into the cavity 7 in the lower pen body 9. This cartridge 19 can be equipped with a brush with flat bristles 20, which brush protrudes therefrom and a channel leads to the bristles thereof, so that the brush bristles 20 are supplied with gel directly from the cartridge due to a capillary action or by compressing the cartridge. The brush is contained in the pen rotated by 180° compared to the versions according to FIGS. 1 to 3 and, after removing the lid cap 2, the brush can be guided directly with the pen. The gel cartridge 19 is accommodated in the lower pen body 9 and is connected to the pen body 9. A rotating mechanism can be implemented together with the upper pen body 4, in which the cartridge is also held there. The two parts 4, 9 of the pen body can then be rotated against one another, whereby a cartridge 19 made of rubber-elastic material can be rotated. As a result of the associated reduction in the filling volume of the cartridge 19, the gel is conveyed into the brush bristles 20. A flat compartment similar to a knife sheath can be provided in the pen body 1, into which a nailfile can be inserted, the lid cap 2 then forming the handle of this nailfile. In this case, the lid cap 2 is held on the pen body 1 by purely axial attachment by means of a snap-in mechanism, instead of being screwed thereonto. In another variant, the rear end of the nailfile can also be designed in such a way that it can be plugged together with the lid cap 2 after removal, so that the lid cap 2 serves as a handle for the nailfile, or in a similar way the nailfile can be plugged together with the pen body 1 so that the pen body 1 serves as a handle.

With the help of this pen, filled with gel varnish, the gel varnish can be applied to a natural or artificial finger nail anywhere, including on the go. For this purpose, the finger nail is prepared as necessary using the nailfile. Gel varnish 14 is then removed with the brush 5 from the blind hole-like cavity 7 in the pen body 1 and applied to the finger nail so that it is covered completely or as desired by the varnish or gel varnish. Multiple layers of gel 14 can be applied. Thereafter, the lid cap 2 is screwed or plugged back onto the pen body and then the switch 12 is set to ON, so that the LED or LEV light 11 is switched on and emits UV light. The emitted UV light is directed onto the gel varnish 14 on the finger nail, which ensures that it cures in a few seconds. Thus, the gel can be cured instantly on the spot. In this way, gel varnish can be applied to the finger nails and cured on the various finger nails of one hand with the help of the other hand and this utensil.

LIST OF REFERENCE SIGNS

1 Pen body
2 Lid cap
3 Threaded cap on lid cap
4 Upper part of the pen
5 Brush
6 Thread on pen body 1
7 Cavity, blind hole
8 Thread on lid cap 2

9 Lower part of the pen with cartridge
10 Thread at the lower end of the pen body
11 LED/LEV light
12 Switch for LED/LEV light
13 Inner cone at the front end of the pen
14 Gel varnish
15 Battery, battery pack
16 Clip-on clip
17 Flat bristles
18 Sleeve at the front end of the pen
19 Cartridge
20 Brush bristles
21 RFID chip
22 Receiving container for RFID chips

The invention claimed is:

1. A pen comprising: a closable cavity for receiving gel varnish; a brush for applying this to a finger nail; and a battery-operated LED/LEV light for UV light for curing gel varnish applied with a brush to a finger nail and in that it contains one or more RFID chips in a further closable cavity, for removal and placement onto a finger nail and attachment thereto by means of applying the gel varnish as required.

2. The pen according to claim 1, wherein the pen is similar in its external shape to that of a ballpoint pen or fountain pen and has a tube-type pen body for receiving gel varnish, and a lid cap which can be screwed on or plugged onto the pen body as a handle for the brush protruding into the gel varnish container on this handle, and, at the front end of the pen body, a sleeve which can be screwed on, and the LED/LEV lights contained therein, with a battery/battery pack, for curing the applied gel varnish with the UV light.

3. The pen according to claim 1, further comprising a compartment for receiving a nailfile which, after removal, can be plugged together with a pen body or a threaded cap to form the pen body, so that they form a handle for the nailfile.

* * * * *